United States Patent [19]

Sandhaus

[11] Patent Number: 4,479,585

[45] Date of Patent: Oct. 30, 1984

[54] TAMPER RESISTANT SAFETY CLOSURE AND CLOSURE-CONTAINER COMBINATION

[76] Inventor: Jeffrey Sandhaus, Rte. 9W, Snedens Landing, N.Y.

[21] Appl. No.: 441,546

[22] Filed: Nov. 15, 1982

Related U.S. Application Data

[63] Continuation-in-part of Ser. No. 399,237, Jul. 19, 1982, , which is a continuation-in-part of Ser. No. 355,216, Dec. 28, 1981, Pat. No. 4,413,742.

[51] Int. Cl.[3] ..... B65D 55/02

[52] U.S. Cl. ..... 215/218; 215/216; 215/250; 215/301; 215/330

[58] Field of Search ..... 215/201, 216, 217, 218, 215/250, 301, 246, 273, 330

[56] References Cited

U.S. PATENT DOCUMENTS 4,227,616 10/1980 Lecinski, Jr. et al. ..... 215/246

*Primary Examiner*—George T. Hall

*Attorney, Agent, or Firm*—Steinberg & Raskin

[57] ABSTRACT

A safety closure of the type having a unitary construction with a closed top from which an interiorly threaded skirt depends and a container having an exteriorly threaded neck on which the closure is mounted in sealing relationship. The safety closure has at least one locking member formed integrally therewith which is movable under the action of actuating apparatus between a non-locking position and a locking position in which the locking members engage appropriate corresponding locking elements provided on the neck of the container. The actuating apparatus is constituted by the top of the closure which has a dish-like configuration formed such that the application of a sufficient finger pressure on the top will result in the movement of the locking members from the locking to the non-locking position. The construction and mode of operation of the safety closure renders it especially suited to the incorporation of a device for providing a visual indication of the initial unlocking actuation of the closure thereby indicating a possible unauthorized tampering with the contents of the container should the device indicate such unlocking actuation prior to the sale of the product to the consumer.

34 Claims, 45 Drawing Figures

92
94
96
96a
96b
98
98a
98b
100
102
102a
102b
103
104
106
108
110
112
114
116
12
27
28
30

TAMPER RESISTANT SAFETY CLOSURE AND CLOSURE-CONTAINER COMBINATION

BACKGROUND OF THE INVENTION

This application is a continuation-in-part of U.S. patent application Ser. No. 399,237, filed July 19, 1982, which is a continuation-in-part of U.S. patent application Ser. No. 335,216 filed Dec. 28, 1981, now U.S. Pat. No. 4,413,742.

The present invention relates generally to closures or caps and, more particulary, to safety closures and tamper-resistant closures.

It is of course desireable to provide for the closing of bottles or containers in a manner which will prevent access to dangerous or poisonous substances contained therein. For example, various types of pharmaceuticals including pills and liquids are packaged in bottles or containers which are stored on shelves in medicine cabinets or the like within easy reach of children. Moreover, many toxic household substances are packaged in bottles or cans which are stored within easy reach of children. In order to prevent or at least discourage children from gaining access to such dangerous substances, safety closures or caps have been suggested which are intended to close a bottle or container in a manner so as to make it difficult for a child to remove the cap from the bottle, either intentionally or through inadvertence. Such known safety closures generally must be manipulated in a certain fashion in order to unlock the same from the bottle to permit its subsequent removal. For example, reference is made to the safety closures disclosed in U.S. Pat. Nos. 3,182,840 to Polzin, 3,514,003 to Fitzgerald, and 4,106,651 to Lemons.

However, none of the known safety closures are entirely satisfactory in use, and for this reason, many dangerous substances can still be found packaged in bottles or containers which are not provided with safety closures.

In general, a safety closure should have certain desirable features from both the standpoint of operation as well as from the standpoint of economy in manufacture. One important feature is that the opening of the bottle should be accomplished without any complicated or difficult maneuvers being required in order to permit ready access to the contents of the container for legitimate use. In this connection, it is important that the closure be readily removable not only by healthy adults but also by the elderly or infirm. Indeed, a significant problem restricting the wide adoption of presently available safety closures is the great degree of difficulty encountered by elderly or infirm individuals in performing the complicated and difficult manipulations required to remove such safety closures. On the other hand, however, the safety closure must be designed so as to present at least a minimum degree of difficulty to its being unlocked and removed in order to prevent young children from obtaining access to the contents. In this respect, it is especially desirable for the safety closure to be designed in a manner such that the degree of difficulty in removing the same from the bottle can be adjustably varied during manufacture to suit specific requirements.

It is also desirable that an option be provided whereby the safety closure can be used in either a so-called safety or locking mode wherein unauthorized removal from the container is prevented and a non-locking mode wherein the cap can be removed from the container in the same manner as conventional so-called non-safety closures, i.e., by merely unscrewing the cap from the bottle. For example, it may be desired in households where there are no young children to permanently dispense with the necessity of maniuplating the closure to unlock the same from the bottle every time access to the contents thereof is indicated.

Another desirable feature of a safety closure is that a visible or other easily discernable signal be provided which will readily indicate whether the closure is locked or lockable to the container or is in an unlocked or unlockable condition wherein the closure can be removed from the container in the same manner as conventional non-safety closures without the need for an unlocking manipulation. Such a feature is especially beneficial where the closure is operated by an individual whose vision is impaired.

The safety closure should be readily adaptable for use with a wide range of container types and sizes thereby enabling closure of the great preponderance of packaging styles for both drugs as well as household substances.

In connection with the manufacture of the safety closure, it is desirable that the basic design thereof be relatively simple, namely a one-piece or unitary structure, which requires no special materials for its construction.

The closure member should meet all requirements for reliably preserving and storing pharmaceutical and household substances in both liquid and solid form and have a configuration which is both attractive and which facilitates being grasped by the user.

Another desirable feature of a closure, whether of the safety type or otherwise, is that means be incorporated therein for inhibiting unauthorized tampering with the contents of the container prior to the first legitimate removal of the closure therefrom. Thus, recent incidents of undetected malicious tampering with over-the-counter pharmaceuticals and other products prior to their sale to the consumer have emphasized the importance of providing effective means for preventing unauthorized tampering with the contents of containers prior to the containers being legitimately opened for the first time. Accordingly, it is desirable to incorporate a feature in a closure or cap for a container which will provide a readily visual indication or signal of any previous unauthorized removal of the closure from the container prior to the sale of the product and the initial legitimate opening thereof. Such a readily visual indication of prior removal of the cap from the container will effectively inhibit tampering with the contents of the container since a purchaser perusing various products on retail shelves will immediately become aware that the closure may have been removed from the container merely by a quick visual inspection of the product.

SUMMARY OF THE INVENTION

Accordingly, it is a main object of the present invention to provide new and improved closures having one or more of the desirable features enumerated above and which overcomes the disadvantages of the prior art closures.

More particularly, it is an object of the present invention to provide a new and improved safety closure for a container in which a dangerous substance is packaged which will reliably prevent unauthorized access to the container contents yet which does not required complicated or difficult manipulations to unlock the closure from the bottle.

Another object of the present invention is to provide a new and improved safety closure which can be used in either a so-called safety or locking mode or in a non-locking mode wherein the closure can be removed from the bottle in the same manner as a so-called non-safety closure, i.e., by merely untwisting the cap from the bottle.

Still another object of the present invention is to provide a new and improved safety closure wherein a visual, audible and/or palpable signal is provided which indicates that the closure is locked to or has been unlocked from the container and/or is in a locking or non-locking mode.

A further object of the present invention is to provide a new and improved safety closure having a design whereby the degree of difficulty encountered in removing the closure from the bottle can be adjustably varied during manufacture in order to suit specific requirements.

Yet another object of the present invention is to provide a new and improved safety closure having a unitary or one-piece construction which is economical in manufacture, capable of closing a wide variety of types of containers and bottles in which liquid or solid substances are contained and which is attractive in appearance.

Another important object of the present invention is to provide a new and improved tamper-resistant closure or cap for a container. In particular, it is an object of the invention to provide a closure which incorporates a device which will provide a readily visual indication that the closure has at some time already been removed from the container and therefore which will indicate by a casual visual inspection the possibility that the contents of the container have been tampered with, e.g., should the device indicate such removal prior to the sale of the product to the consumer.

Briefly, in accordance with the present invention, certain ones of these and other objects are attained by providing an improved safety closure or cap of the type having a unitary or one-piece construction with a closed top from which an interiorly threaded skirt depends and which is mounted in sealing position on a threaded neck of a bottle by positioning the cap over the bottle neck and twisting or rotating the cap until its top closes the open bottle end. Conversely, the closure is removed by untwisting the cap over the bottle neck.

According to the invention, the safety closure is constructed of a substantially rigid but resilient material and with at least one locking means being formed integral therewith which is movable under the action of certain actuating means between a non-locking position and a locking position in which the locking means are engaged with or disengaged from appropriate corresponding locking elements provided on the bottle neck. The actuating means are constituted by the top of the closure which has a normally convex dish-like or dome-like shape and which is formed with the closure member in a particular manner such that the application of a sufficient finger pressure on the cap will result in movement of the locking means from the locking to the non-locking position. The cap is thus threaded onto the bottle by twisting until the cap is in sealing position at which time the locking means engages a corresponding locking element on the bottle neck to prevent the cap from being rotated in the opposite direction and thereby removed. However, when it is desired to reach the contents of the bottle, the top of the closure is depressed by applying a sufficiently large finger pressure thereto whereupon the locking means disengage from the locking elements allowing the cap to be untwisted from the bottle.

The threshold finger pressure on the closure top required to actuate the movement of the locking means can be selected through suitable design of the closure such, for example, as by slightly varying material thicknesses or the like. It is believed that a threshold actuation pressure of 8 pounds is satisfactory to preclude most young children from unlocking the closure except with the most concerted effort.

In accordance with the present invention, a tamper-resistant closure or cap is also provided. The tamper-resistant closure construction is applicable to any type of closure or cap whose contour or configuration must be altered or changed in connection with effecting its removal from the associated container. For example, a tamper-resistant closure in accordance with the invention may be incorporated in a twist-type threaded safety cap, such as described above, or may be incorporated in a non-safety closure construction such as a conventional "snap-fit" construction. In an illustrated embodiment the tamper-resistant closure is formed with a top having a normally convex dish-like or dome-like shape formed of a resilient material so as to be depressable by the application of suitable finger pressure in connection with the removal of the cap from the container. Thus, the tamper-resistant closure may be incorporated in the safety closure construction described above or, for example, in a cap of the type disclosed in U.S. Pat. No. 4,187,953 to Turner which comprises a snap-type cap having a dome-shaped top which is depressed in connection with removing the cap from the container.

In one embodiment of a tamper-resistant closure according to the invention, a non-pliable, readily frangible substance, such as a thin film of lacquer or the like, is applied to the upper surface of the top of the closure which will provide a visual indication of the occurrence of the first or initial depression of the closure top and thereby provide a visual indication of the possible removal of the closure from the container. More particularly, the initial depression of the dome-like top of the closure to effect the disengagement of the locking means from the locking elements (in the case where the tamper-proof construction is incorporated in the safety closure described above) will result in a visible fracture, splitting, cracking, spidering or separation of the applied non-pliable substance which thus provides a visual indication that the closure has possibly at some time already been removed from the container. Accordingly, it will be readily apparent to a consumer inspecting a container having a closure according to the invention, prior to the purchase thereof, whether that container has already been opened and the contents thereof possible tampered with. Other embodiments of tamper indicating means in accordance with the invention are disclosed. For example, a strip of foil or tape can be fixed to the dome-shaped top of the closure in a manner such that the initial depresssion of the closure top will cause the strip to rupture thereby providing a readily visual indication that the cap may have been previously removed from the container.

The present invention also comprises a combination of the safety closure and the container associated therewith.

Other advantages provided by the closure and combination of the invention, several embodiments of which are disclosed hereinbelow, will become apparent from the description which follows.

DESCRIPTION OF THE DRAWINGS

A more complete appreciation of the present invention and many of the attendant advantages thereof will be understood by reference to the following detailed description when considered in connection with the accompanying drawings in which.

DESCRIPTION OF THE PREFERRED EMBODIMENTS

Figure 2:
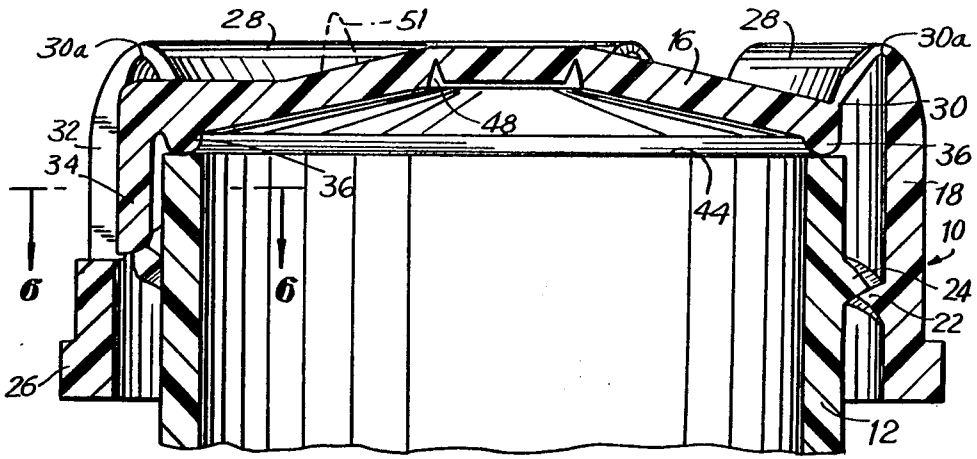
FIG. 2 is a section view taken along line 2—2 of FIG. 1.
Figure 1:
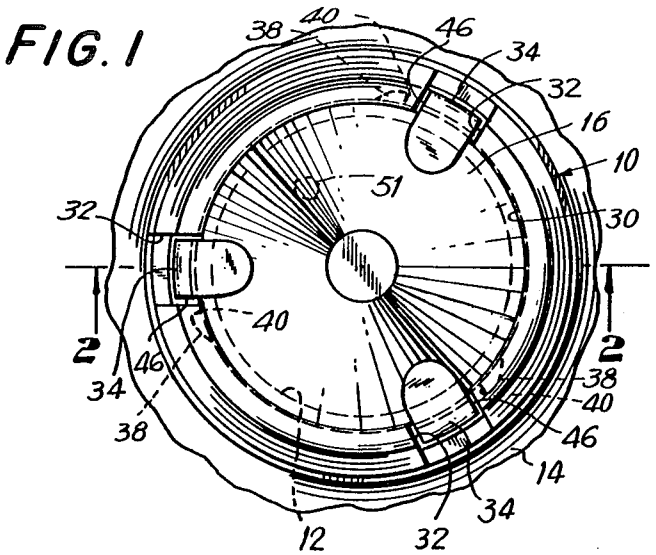
FIG 1 is a top plan view of one embodiment of a safety closure according to the present invention in sealing position on a bottle or container.
Figure 3:
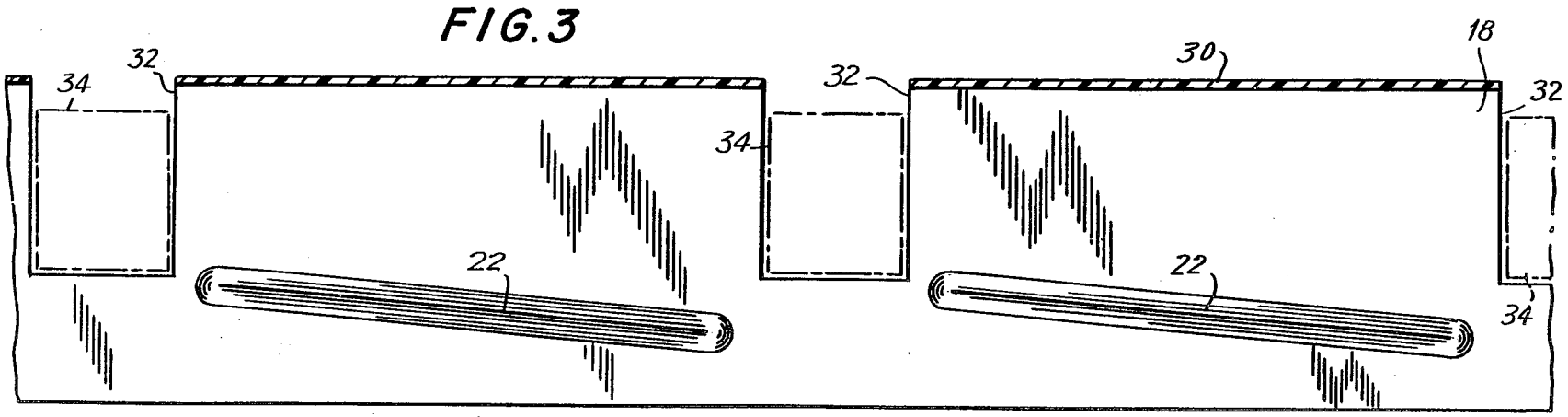
FIG. 3 is a development view illustrating the inner surface of the peripheral skirt of the closure embodiment of FIG. 1.

Referring now to the drawings wherein like reference characters designate identical or corresponding parts throughout the several views and in particular to the embodiment of the invention illustrated in FIGS. 1–8, a safety closure or cap, generally designated 10, is shown mounted on the neck 12 of a bottle or container 14. Referring in particular to FIGS. 1–3, the illustrated embodiment of the safety closure 10 has a unitary or one-piece construction including a closed top 16 from which a peripheral skirt 18 depends. The closure is formed of a substantially rigid but resilient material, such as plastic, preferably by conventional injection molding techniques. Threads are formed on the interior surface of skirt 18 adapted to mate with corresponding threads formed on the exterior surface of the bottle neck 12. Although in the illustrated embodiment the thread structure comprises three flights 22 (only two shown in FIG. 3) equally spaced from each other around the circumference of skirt 18 and three corresponding equally spaced flights 23 (only two shown in FIG. 4) on the bottle neck 12, it is understood that conventional helical thread structure may be utilized. The lower end of the skirt 18 is formed with a thickened rib portion 26 for purposes which will be made clearer hereinbelow.

The upper edge region of skirt 18 extends upwardly beyond the peripheral edge region of the top 16 and is integrally connected thereto by a web portion 28 which itself extends between junctions 30 and 30a which have a reduced thickness relative to that of the skirt and top.

A number of slots 32 are formed through the skirt 18, each of which extends downwardly from the web portion 28. In the illustrated embodiment, three such slots 32 are formed which are equally spaced from each other by 120° center-to-center intervals. A corresponding number of tab-like locking members 34 are integrally joined to the peripheral edge region of top 16, each of the locking members being aligned with and receivable within a respective one of the slots 32. Thus, in the illustrated embodiment, three locking members 34 spaced at 120° center-to-center intervals from each other are integral with and extend downwardly from the top 16 of cap 10. As best seen in FIG. 2 wherein the cap 10 is illustrated in its so-called locked mode such that removal from the bottle neck is prevented, the locking members extend downwardly from the top 16 and are displaced radially inwardly with respect to the skirt 18, the web portion 28 serving to space the skirt somewhat outwardly with respect to the peripheral edge region of top 16. A bead 36 is formed on the undersurface of top 16 to sealingly engage the upper edge of the bottle neck 12.

Figure 4:
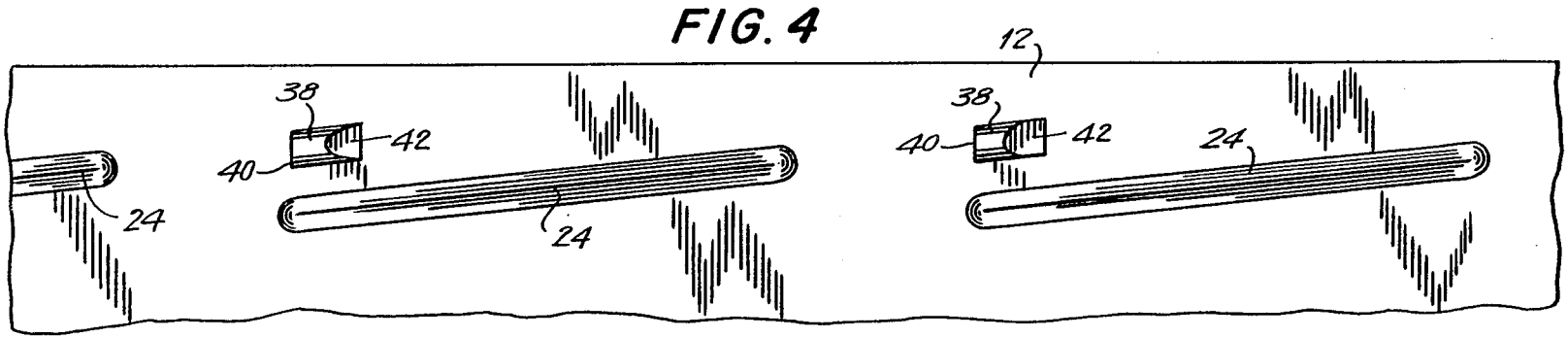
FIG. 4 is a development view illustrating the upper region of the outer surface of the bottle of FIG. 1.
Figure 5:
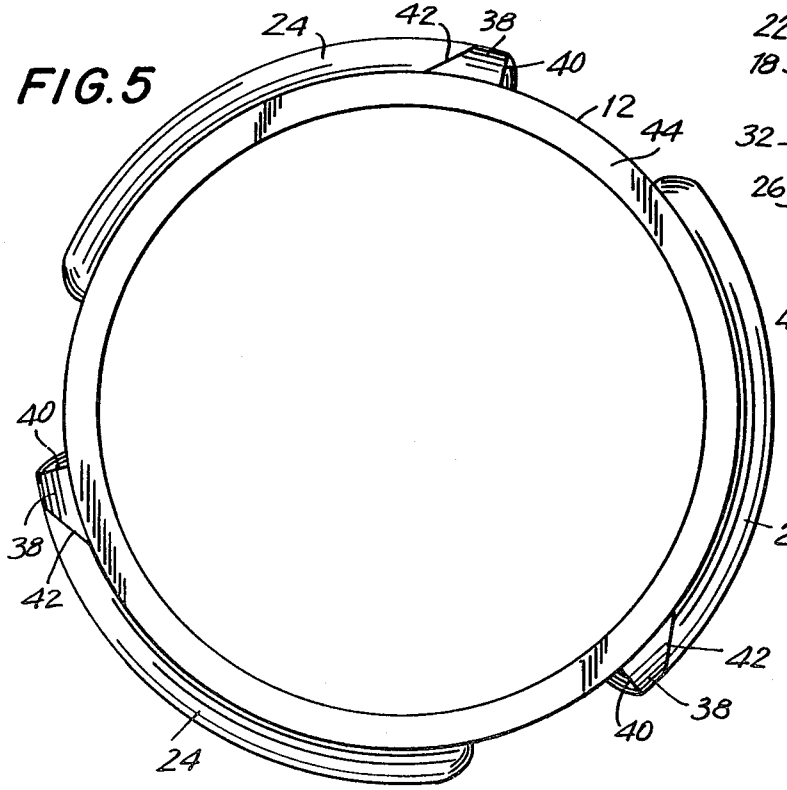
FIG. 5 is a plan view of the bottle or container of FIG. 1.

Referring to FIGS. 4 and 5, the bottle neck 12 has a number of protuberances formed thereon situated over the threads 24 and preferably corresponding in number and spacing to the number and spacing of locking member 34. Each of the protuberances 38 presents a substantially radial abutment surface 40 facing the clockwise direction when viewed in FIG. 5, and an angled surface 42 facing the counterclockwise direction.

Figure 6:
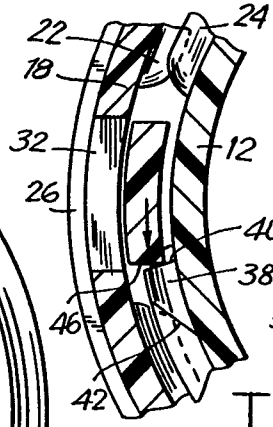
FIG. 6 is a section view taken along line 6—6 of FIG. 2.

In mounting the cap 10 on the bottle neck 12, the cap is situated over the neck and twisted or rotated in a clockwise direction with the corresponding threads mating until the cap descends to a point where bead 36 comes into sealing engagement with the upper edge surface 44 of neck 12 as seen in FIG. 2. During rotation, the locking members 34 in their locking positions illustrated in FIGS. 2 and 6 engage the angled surfaces 42 of protuberances 38 and by virtue of the resilient nature of the material from which the cap is formed, flex outwardly to the extent necessary so that the locking members will ride over the protuberances. As seen in FIGS. 2 and 6, the cap and bottle are suitably configured such that when the cap reaches the position wherein the sealing bead 36 engages the surface 44 of the neck 12, the trailing edge 46 (relative to clockwise rotation of cap 10) of each locking member 34 is contiguous with an abutment surface 40 of a corresponding protuberance 38. It will be readily appreciated that should removal of the cap be attempted by rotating the cap in the counterclockwise direction, the edges 46 of the locking members will abut against and engage the abutment surfaces 40 so that counterclockwise rotation is obstructed. Thus, when the cap according to the invention is tightened over the bottle neck with the locking members in their locking position, it is not possible to untwist the cap by virtue of the construction described above.

Figure 7:
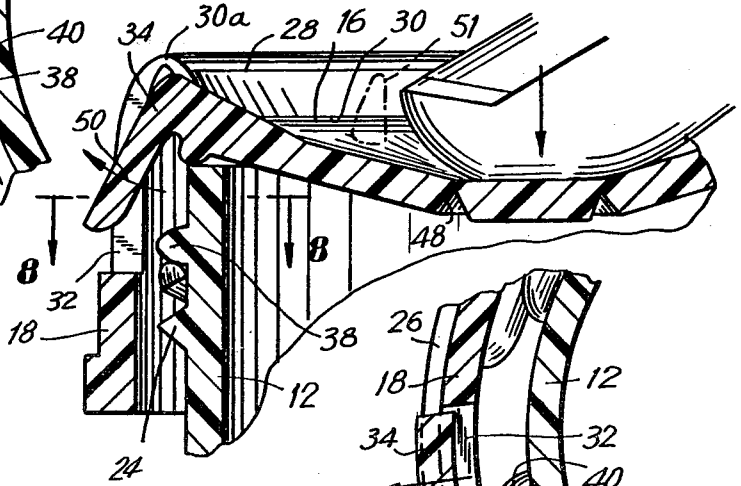
FIG. 7 is a fragmentary view similar to FIG. 2 and illustrating the unlocking of the closure from the bottle.
Figure 8:
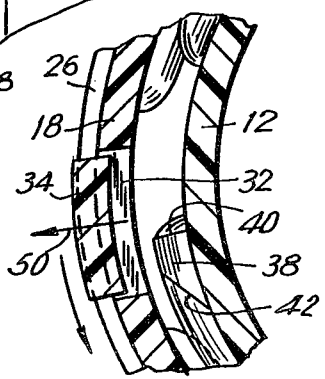
FIG. 8 is a section view taken along line 8—8 of FIG. 7.

According to the present invention, actuating means are provided for moving the locking members 34 from the locking positions illustrated in FIGS. 2 and 6 to non-locking positions illustrated in FIGS. 7 and 8, i.e., to positions wherein the edges 46 of locking members 34 are displaced outwardly from the abutment surfaces 40 of protuberances 38 to thereby permit a counterclockwise rotation and removal of the closure. More particulary, the top 16 of cap 10 has a substantially dish or dome-shaped configuration which when the locking members 34 are in their locking positions extends upwardly in the direction from the peripheral edge region of top 16 to a central region thereof. Thus, the top 16 has a normally convex dish-like construction as best seen in FIG. 2. A hinge groove 48 is formed in the lower surface of top 16 extending around a central portion thereof.

In accordance with the illustrated embodiment, the construction of closure 10 is such that when a downward force greater than a certain minimum force is applied to the central region of top 16, such as by application of finger pressure, the latter will flex and "snap" into a concave or depressed configuration as seen in FIG. 7, the top flexing in the regions of the reduced thickness junctions 30 and **30*a* which act as hinges and the hinge groove 48. Moreover, the closure is preferably constructed as shown so that the top will remain in the depressed or concave configuration after being snapped into that position. Thus, the peripheral region of the top 16 will flex with respect to the hinge portions 30 and 30*a* while the central region of the top will flex about the hinge groove 48 with respect to the outer portion of top 16. The structural rigidity of the skirt which is provided by the hinge structure in addition to the reinforcing rib portion 26 acts to produce this overcenter or "oil-can" type action of the top 16** which is advantageous for reasons made clear below.

Thus, when the central region of the top 16 in its convex configuration is depressed with a force greater than a certain minimum force, it will snap into the position shown in FIG. 7. At the same time the locking members 34 will flex in the direction of arrow 50 (FIGS. 7 and 8) through respective slots 32 whereby the edge 46 of each locking member will move to a disengaged or unlocking position out of alignment with the corresponding abutment surface 50 thereby permitting the cap to be unscrewed from the bottle neck. It should be understood that such flexure does not depend on any camming action between the bead 36 and any structure related to the neck 12.

When the finger pressure is released, the top will remain in its concave confuguration so that the locking members 34 remain in their unlocking positions. This is advantageous in the case where it is desired to use the closure in the same manner as a conventional non-locking type closure, i.e., with the locking feature of the closure permanently disengaged. This may be desired in households where there are no young children. In such a case, the top 16 is always left in its depressed or concave configuration so that the locking members will never be obstructed by the protuberances 38 so that the cap can be merely screwed on and off the bottle as desired in a conventional manner. A lever 51, shown in phantom in FIGS. 1, 2 and 7, may extend from the top 16 which may be manipulated by the user when it is desired to return the cap to its locking mode, i.e., to snap the top back to its convex configuration.

It should also be apparent that the minimum pressure to be applied to the top 16 of cap 10 can be suitably selected during manufacture by appropriate design modifications such, for example, as increasing or decreasing the thickness of the top or the junction 30. The minimum force to actuate movement of the locking member 34 should be at least 8 pounds and preferably in the range of about 10 to 12 pounds which is small enough that elderly or infirm people will have little difficulty in operating the same but which is sufficiently large so that small children will not be able to accomplish an unlocking of the cap.

Another advantage provided by the structure of the invention is that visually, audible and palpable signals are simultaneously provided when the top of the cap is depressed from its locking to its non-locking position. Thus, the fact that the cap is in its non-locking mode will be clearly visually apparent from the concave configuration of the top. Similarly, this configuration is readily apparent by touch which is advantageous for individuals whose vision is impaired. Moreover, when the top snaps from the locked to the unlocked position an audible noise is generated indicative of the condition of the closure.

The safety closure described above may be formed such that after the top 16 has been depressed into its concave configuration FIG. 7) and the depressing finger pressure removed, the top 16 will tend to immediately return to its initial convex configuration. For example, the closure top will tend to snap back to its initial configuration immediately after it has been depressed if the hinge structure or top itself is formed with a reduced thickness. However, it is desirable in such a case to provide means for holding at least the locking members in their non-locking positions even should the dome-shaped top return to its original configuration and, indeed, it is preferable to maintain the top in the depressed configuration in order to permit the cap to be removably rotated at least until the cap has been unscrewed to an extent such that the locking members will clear the abutment surfaces after moving back to their locking position. Thus, in the absence of such locking means, it would be necessary to maintain a continual manual depressing force on the closure top resisting the tendency thereof to return to its original configuration until the locking members have cleared the abutment surfaces.

Figure 41:
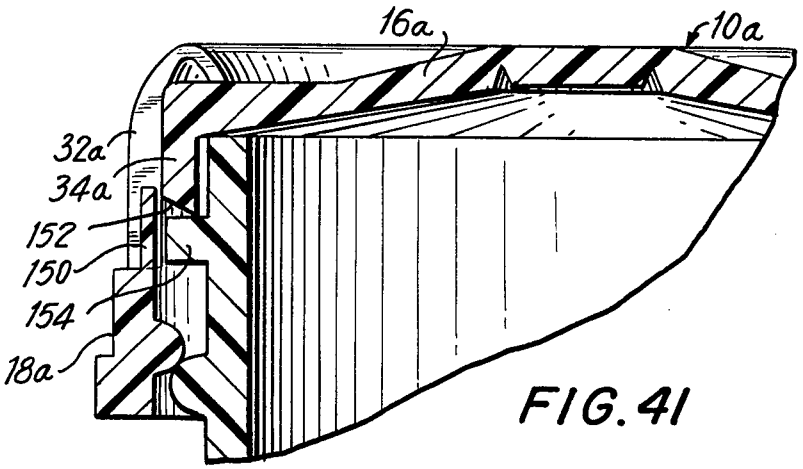
FIG. 41 is a section view taken along line 41—41 of FIG. 40, showing the closure positioned on a container.
Figure 40:
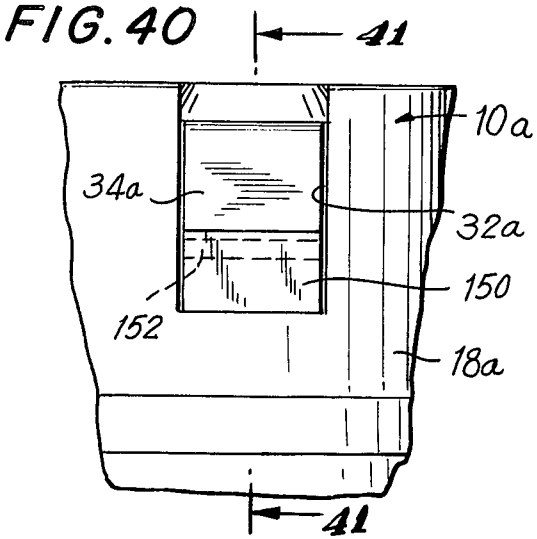
FIG. 40 is a partial side elevation view of a modified safety closure cap in accordance with the present invention.

Referring to FIGS. 40–44 an embodiment of a safety closure of the present invention is illustrated wherein the top tends to return from its depressed configuration to its original convex configuration immediately after removing the finger pressure from the closure top and which is further provided with means for holding the locking members in their non-locking positions and the top in the depressed configuration, at least until the cap has been unscrewed to an extent such that the locking members will clear the abutment surfaces after moving back to their locking positions, at which time the locking members will automatically return to their locking position and the top will snap back to its undepressed state. The cap **1O*a* is constituted substantially similarly to the cap 10 of FIGS. 1–8 in that it includes a dome-shaped top 16*a* integrally formed with an interiorly threaded skirt 18*a* through a web portion 28*a*. At least one tab-like locking member 34*a* is integrally joined to the peripheral edge region of top 16*a* and is aligned with and receivable within a corresponding slot 32*a* formed through the skirt 18*a* as in the case of the embodiment discussed hereinabove. A detention flap 150 extends upwardly partially into the slot 32*a* from the bottom edge thereof and is formed with a reduced thickness so that it is easily deflectable. As seen in FIGS. 40 and 41, the detention flap 150 projects upwardly into the slot 32*a* so that it is positioned directly outwardly of the lower region of locking member 34*a*. It is noted that the lower edge of locking member 34*a* is preferably formed with a downwardly and inwardly bevelled camming surface 152**.

Figure 43:
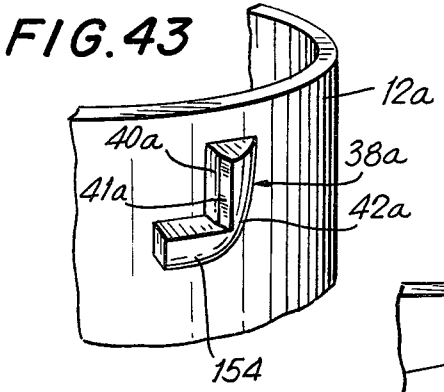
FIG. 43 is a partial perspective view of the neck of the container and illustrating a locking element for use with the embodiment of the closure shown in FIGS. 40–42.
Figure 44:
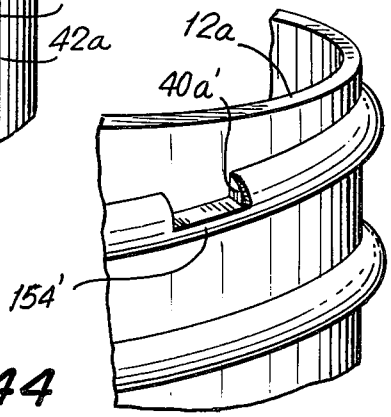
FIG. 44 is a view similar to FIG. 43 and illustrating another embodiment of a locking element for use with the closure shown in FIGS. 40–42.

Referring now to FIGS. 43 and 44, the bottle neck **12*a* is formed with locking elements corresponding in number to the number of tab-like locking members provided on the closure. In the embodiment shown in FIG. 43, the locking element comprises a protuberance 38*a* which, like the protuberance 38 of FIGS. 1–8, presents a substantially radial abutment surface 40*a* facing the clockwise direction when viewed in FIG. 43 and an angled surface 42*a* facing the counterclockwise direction. The terminal edge of abutment 40*a* is bevelled as at 41*a*. However, the protuberance 38*a* further includes a circumferentially extending retaining portion 154 which is situated such that it is positioned inwardly of the detention flap 150 when the closure has been screwed tightly onto the container neck 12*a*. Alternatively, the locking element may be formed in the thread of the container neck as seen in FIG. 44 so as to present an abutment surface 40*a*' and a releasing portion 154'**.

Figure 42:
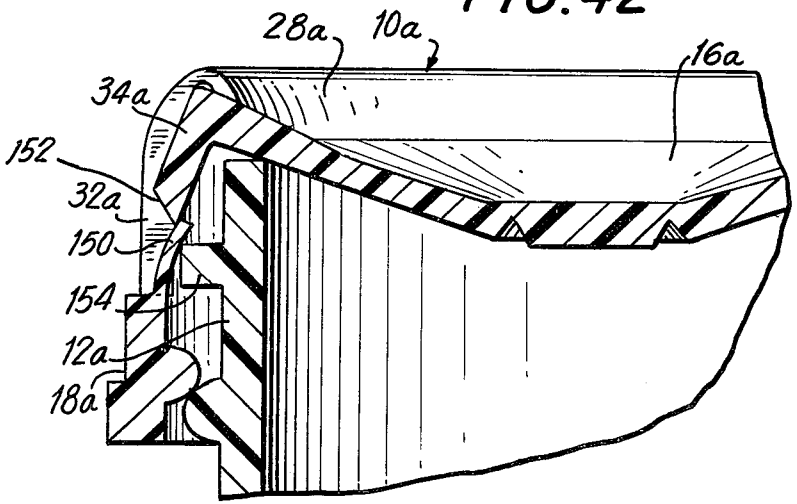
FIG. 42 is a view similar to FIG. 41 illustrating the unlocking of the closure from the container.

In operation, when it is desired to unlock the closure **1O*a*, the top 16*a* is depressed in the manner described above by applying a sufficient finger pressure thereto whereupon the locking member 34*a* is pivoted outwardly so as to move out of engagement with the radial abutment surface 40*a*, 40*a*'. The locking member 34*a* engages the detention flap 150 during its outward movement whereupon the flap 150 deflects to permit the locking member 34*a* to pass to the opposite side thereof whereby the flap 150 becomes situated between the locking member and the retaining portion 154, 154'. Upon release of the finger pressure, the top 16*a* will tend to return or snap back to its original convex dome-shaped configuration. However, the locking member 34*a* is prevented from returning to its locking position by the detention flap 150. Thus, as seen in FIG. 42 the locking member 34*a* engages the detention flap 150 which is prevented from deflecting inwardly by virtue of the retaining portion 154, 154' engaged by it. Accordingly, the locking member 34*a* is held in its non-locking configuration despite the fact that the top 16*a* has returned to its convex configuration. Moreover, the top 16*a* is retained in its depressed state in the same manner. The cap is then unscrewed and as soon as it is rotated to a position where the flap 150 is disengaged from the retaining portion 154, 154', the locking member 34*a* can return to its locking position by deflecting the flap to pass inwardly thereof, whereupon the top 16*a*** will return to its convex configuration.

Referring now to FIGS. 9–14, another embodiment of a safety closure according to the present invention, generally designated 52, is illustrated. The same reference numerals are used in the description of this embodiment as were used to designate corresponding parts in the previously described embodiment.

The closure 52 has essentially the same construction as closure 10 wherein the top will remain in the depressed configuration after release of finger pressure. However in the embodiment of FIGS. 9–14, means are provided whereby after the locking members 34 are moved to their unlocking position in connection with the removal of cap 10 from the bottle neck 12, the locking members 34 will be automatically returned to their locking positions as the cap is untwisted from the bottle. Accordingly, it is not necessary for the user to remember to "snap" the dish-shaped top back from its concave non-locking configuration into its locking configuration every time the cap is removed from the bottle.

Figure 11:
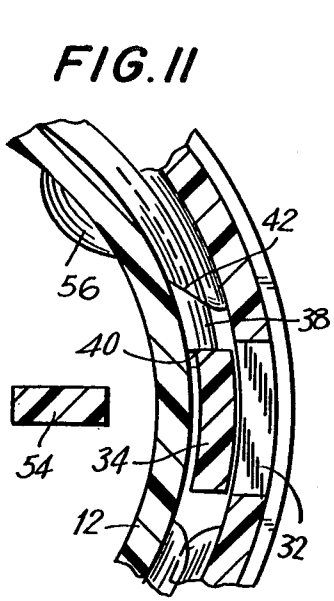
FIG. 11 is a section view taken along line 11—11 of FIG. 10.
Figure 10:
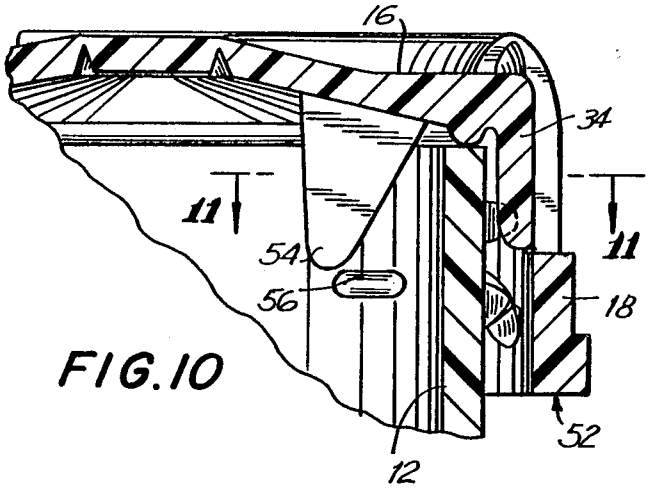
FIG. 10 is a section view taken along line 10—10 of FIG. 9.
Figure 9:
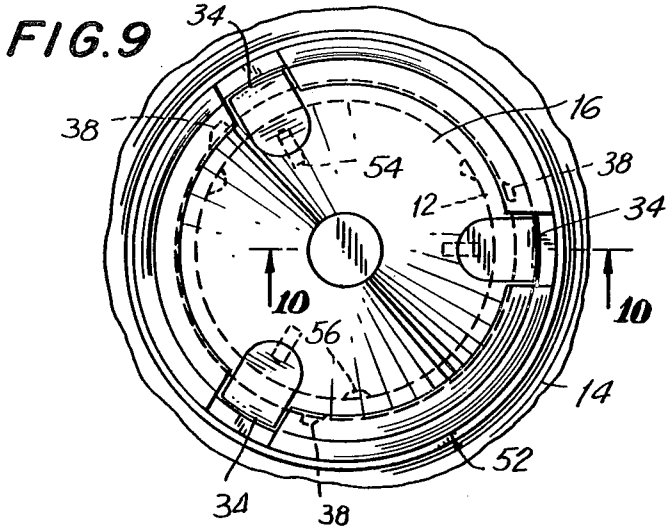
FIG. 9 is a plan view similar to FIG. 1 and illustrating a second embodiment of a closure and closure-bottle combination according to the present invention wherein provision is made for returning the closure to its locking mode during the untwisting rotation of the cap.

To this end a finger 54 extends downwardly from the undersurface of top 16 of cap 10 such that it extends within the neck 12 of the bottle when the cap is mounted thereon. Moreover, a protuberance 56 is formed on the inner surface of neck 12 extending radially inwardly a limited distance. As seen in FIGS. 9–11, when the cap is in its locked mode, i.e., with the top 16 in its convex configuration, the finger 54 extends away from the inner surface of the neck 12 in the downward direction so as to be spaced a sufficient distance therefrom such that the finger 54 will not engage the protuberance 56 as the cap is rotated as seen in FIGS. 9–11. Thus, as seen in FIGS. 9–11, when the cap 10 is in its locked mode with the locking members 34 in their locking positions, a clockwise or tightening rotation thereof will mount the cap on the bottle in the same manner as described above in connection with FIGS. 1–8. The finger 54 will not engage the protuberance 56 during such tightening rotation. FIG. 11 depicts the cap-bottle combination with the cap 10 sealingly locked to the bottle neck 12.

Figure 14:
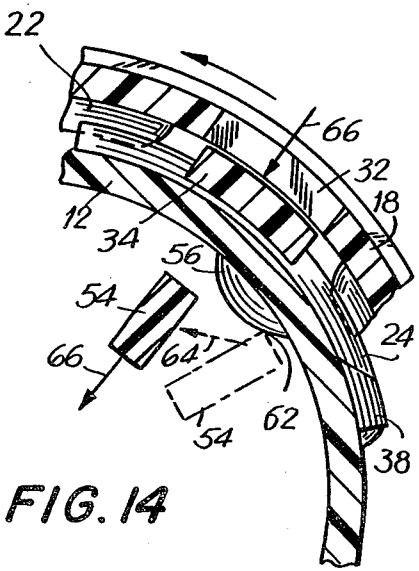
FIG. 14 is a view similar to FIG. 13 illustrating the return of the closure to its locking mode during the untwisting operation.
Figure 13:
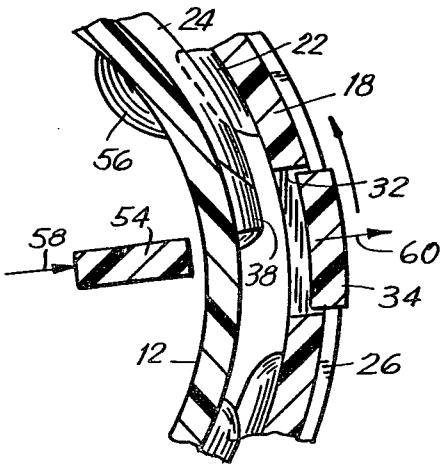
FIG. 13 is a section view taken along line 13—13 of FIG. 12.
Figure 12:
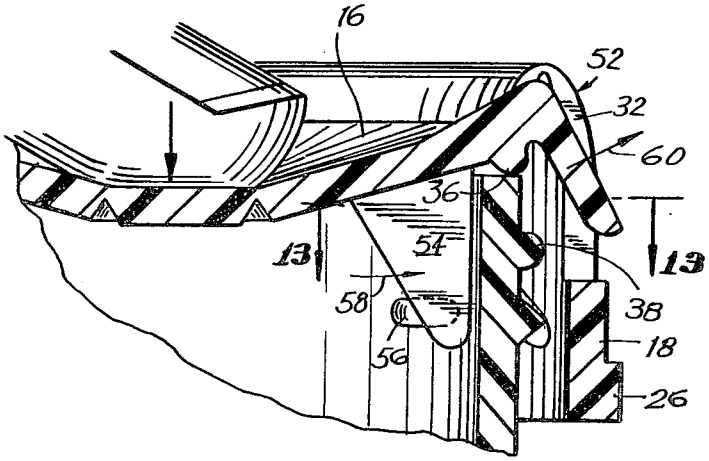
FIG. 12 is a view similar to FIG. 7 illustrating the unlocking of the closure illustrated in FIG. 9.

When access to the contents of the container is desired, the top 16 is depressed through the application of at least the minimum force required as seen in FIG. 12 so that the top 16 "oilcans" to the position illustrated. At the same time, the finger 54 which is attached to the lower surface of top 16 moves to the position illustrated in FIGS. 12 and 13 as indicated by arrow 58 as the locking members 34 flex to their non-locking positions designated by arrows 60. It is therefore seen that with the locking members 34 in their unlocked position, the finger 58 has moved closer to the inner surface of the bottle neck 12. Thus, a subsequent counterclockwise untightening rotation of the cap, which is permitted by virtue of the locking members 34 having been moved out of alignment with the abutment surface 40 of protuberance 38, will result in the finger 54 engaging the protuberance 56 at the point designated 62 (FIG. 14). The protuberance 56 is so shaped that continued rotation of the cap results in a camming action urging the finger 54 in an inward direction as designated by arrow 64 causing the top 16 to flex towards its locked or convex configuration. When the top flexes to a sufficient degree, it will snap to its locked configuration causing the locking members 34 to move into their locked positions as designated by arrows 66 in FIG. 14.

It is therefore seen that the embodiment of the safety closure illustrated in FIGS. 9–14 has a feature whereby the cap will return to its locked mode from its unlocked condition in an automatic fashion as it is untightened from the bottle neck. Thus, the cap is in condition for being remounted on the bottle neck in its locking configuration as soon as it is removed from the bottle.

Figures 15, 16, 17, 18, 19, 20, 21, 22, 23, 24, 25:
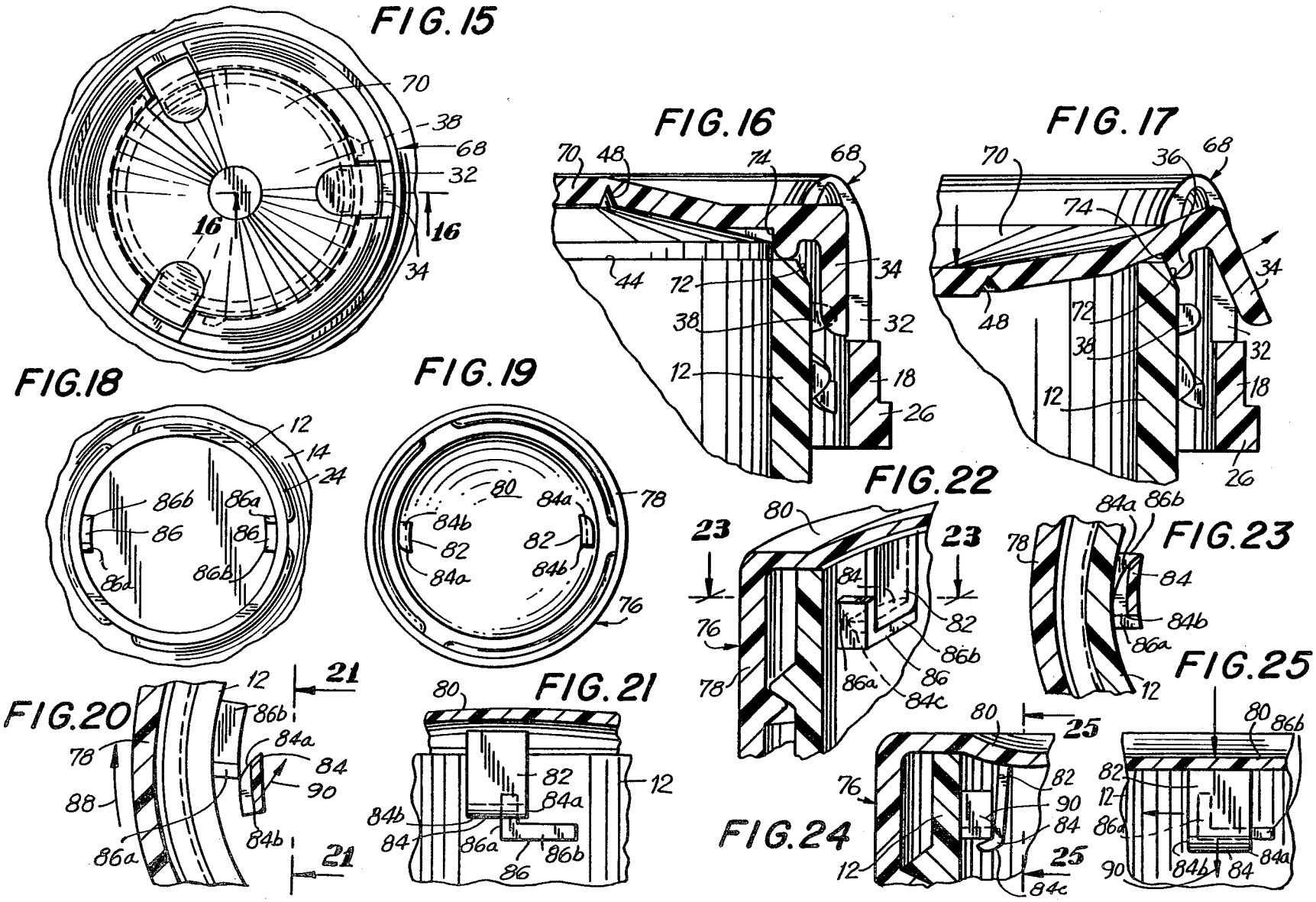
FIG. 15 is a plan view of a third embodiment of a closure and closure-bottle combination according to the present invention.
FIG. 16 is a section view taken along line 16—16 of FIG. 15.
FIG. 17 is a view similar to FIG. 16 and illustrating the unlocking operation of the closure.
FIG. 18 is a plan view of the neck of a bottle forming a part of a closure-bottle combination according to yet another embodiment of the present invention.
FIG. 19 is a bottom plan view of a closure forming a part of the embodiment of the closure-bottle combination of FIG. 18.
FIG. 20 is a fragmentary view illustrating the locking operation of the embodiment of the invention illustrated in FIGS. 18 and 19.
FIG. 21 is a view taken in the direction of line 21—21 of FIG. 20.
FIG. 22 is a fragmentary perspective view of the embodiment of the invention illustrated in FIGS. 18–21 with the closure being locked to the bottle.
FIG. 23 is a section view taken along line 23—23 of FIG. 22.
FIG. 24 is a fragmentary view of the embodiment illustrated in FIGS. 18–23 during the unlocking of the closure from the bottle.
FIG. 25 is a view taken in the direction of line 25—25 of FIG. 24.

Another embodiment of a closure according to the present invention which provides an automatic return of the locking members to their locked positions as the cap is rotated to untighten the same from the bottle neck is illustrated in FIG. 15–17. Again, the same reference numerals are used in the description of this embodiment as were used to designate corresponding parts in the embodiment illustrated in FIGS. 1–8.

The safety closure, designated 68, has essentially the same structure as cap 10 except as follows. The top 70 has a modified form relative to the top 16 such that when depressed to the concave or unlocked configuration illustrated in FIG. 17 and the finger pressure removed therefrom, the top 70 will normally spring back to its convex locked configuration illustrated in FIG. 16. In other words, unlike the top 16 of the previously described embodiments, the top 70 is formed such that when the finger pressure is removed after flexing the top 70 to its unlocked configuration, the top will normally return unless otherwise restrained in the position illustrated in FIG. 16. Such return action is achieved by reducing the depth of the hinge groove 48, for example.

According to this embodiment, the outer region of the upper edge surface 44 of bottle neck 12 is beveled as at 72 and the bead 36 is formed with an inwardly facing planar surface 74.

In operation, with the cap 68 in its tightened condition wherein it is locked to the bottle neck 12 as seen in FIG. 16, the top 70 is depressed by a finger force in excess of the minimum required force whereupon the locking members 34 move from their locked position to their unlocking position illustrated in FIG. 17. At the same time, the bead 36 moves radially outwardly on the upper edge surface 44 of bottle neck 12 until the axial surface 74 of the bead engages the beveled edge surface 72 of the bottle neck. The engagement of the bead surface 74 and beveled edge surface 72 acts to restrain the top 70 from returning to the unflexed locked configuration of FIG. 16. Thus, the user can remove pressure from the top 70 and with the locking members 34 being held in their nonlocking positions untwist the cap. However, when the cap has been unscrewed to an extent whereby the axial surface of bead 74 becomes disengaged from the beveled edge surface 72, all restraints tending to hold the top in its depressed condition are removed whereupon the top will automatically return to its locking configuration illustrated in FIG. 16. Thus, it is recognized that in this embodiment as well as the embodiment illustrated in FIGS. 9–14, the user can release the pressure on the top of the cap after depressing the same since the cap will remain in its unlocked configuration whereupon the cap can be untwisted and that during such untwisting the cap will automatically return to its locking configuration.

Referring now to the embodiment of the invention illustrated in FIGS. 18–25, a safety closure, generally designated 76, comprising yet another embodiment of the present invention is illustrated. The closure 76 is similar to the embodiment described hereinabove in that locking means are formed integrally with the safety closure which are movable between non-locking and locking positions in the latter of which the locking means engage appropriate corresponding locking elements provided on the bottle neck and wherein actuating means are provided for moving the locking means which comprise a normally convex dome or dish-shape top of the closure. However, the closure 76 differs from the previously described embodiments in that the locking means are integrally formed with the closure cap in a manner so as to extend within the interior space defined by the bottle neck and cooperate with locking elements formed on the inwardly facing surface of the bottle neck.

More particularly, the closure 76 includes a peripherally extending interiorly threaded skirt 78 and an integral top 80 having a dome or dish-shaped configuration as seen in FIGS. 21 and 22. A pair of locking members 82 extend downwardly from the dome-shaped portion of top 80 terminating at their lower ends with outwardly extending portions 84 which will be located substantially contiguous with the inner surface of the bottle neck 12 when the cap is being tightened thereon. The leading edge 84*a* in the clockwise or twisting direction is curved as seen in FIGS. 19, 20 and 23 while the trailing edge 84*b* is substantially radial. It is noted that one or more such locking members 82 may be provided, two being shown in the illustrated embodiment.

A corresponding number of inwardly extending substantially L-shaped locking elements 86 are provided on the inner surface of bottle neck 12. Thus, each locking element 86 includes an axially extending portion 86*a* and a circumferentially extending portion 86*b*.

The function of the elements described above will be readily understood from a description of the operation of this embodiment of the safety closure. In order to tighten the closure 76 on the bottle neck 12, the closure is situated over the bottle neck and rotated in a clockwise direction as indicated by arrow 88 in FIG. 20. Eventually, the curved leading edges 84*a* of the catch portions 84 engage the axially extending portions 86*a* of the locking elements 86. However, further rotation in this direction is possible by virtue of the fact that the catch portions 84 will be cammed inwardly as designated by arrow 90 in FIG. 20 so that the cap can be fully tightened over the bottle neck. When the cap reaches its tightened position on the bottle neck, the catch portions 84 of locking members 82 have snapped into the position illustrated in FIGS. 22 and 23 relative to the locking elements 86. It will be seen that a counterclockwise or untwising rotation of the cap 76 will be prevented by virtue of the abutment of the trailing edge 84*b* of the catch portions 84 with the axially extending portion 86*a* of the locking elements 86.

When it is desired to gain access to the bottle, the dome-shaped top 80 of the cap 76 is depressed as seen in FIG. 24. When this occurs the lower surface 84*c* which is curved as seen in FIG. 22 cams outwardly and downwardly in the direction designated by arrow 90 in FIGS. 24 and 25 wherein the axially extending portions 86*a* of locking elements 86 no longer present an obstacle to the counterclockwise untwisting rotation of cap 76. Thus, the cap 76 can then be removed from the bottle neck 12. When the cap is unscrewed from the bottle neck, the dome-shaped top 80 will resume its original shape in preparation for being mounted again on the bottle neck.

Another embodiment of a safety closure, designated 92, according to the present invention is illustrated in FIGS. 26–30. This embodiment of the closure is similar to the embodiments described above in that it comprises a normally dish or dome-shape top 94 which constitutes actuating means for moving locking means integrally formed as part of the closure between a non-locking position and a locking position in which the locking means engage locking elements provided on the bottle neck.

Figures 26, 27, 28, 29, 30, 31:
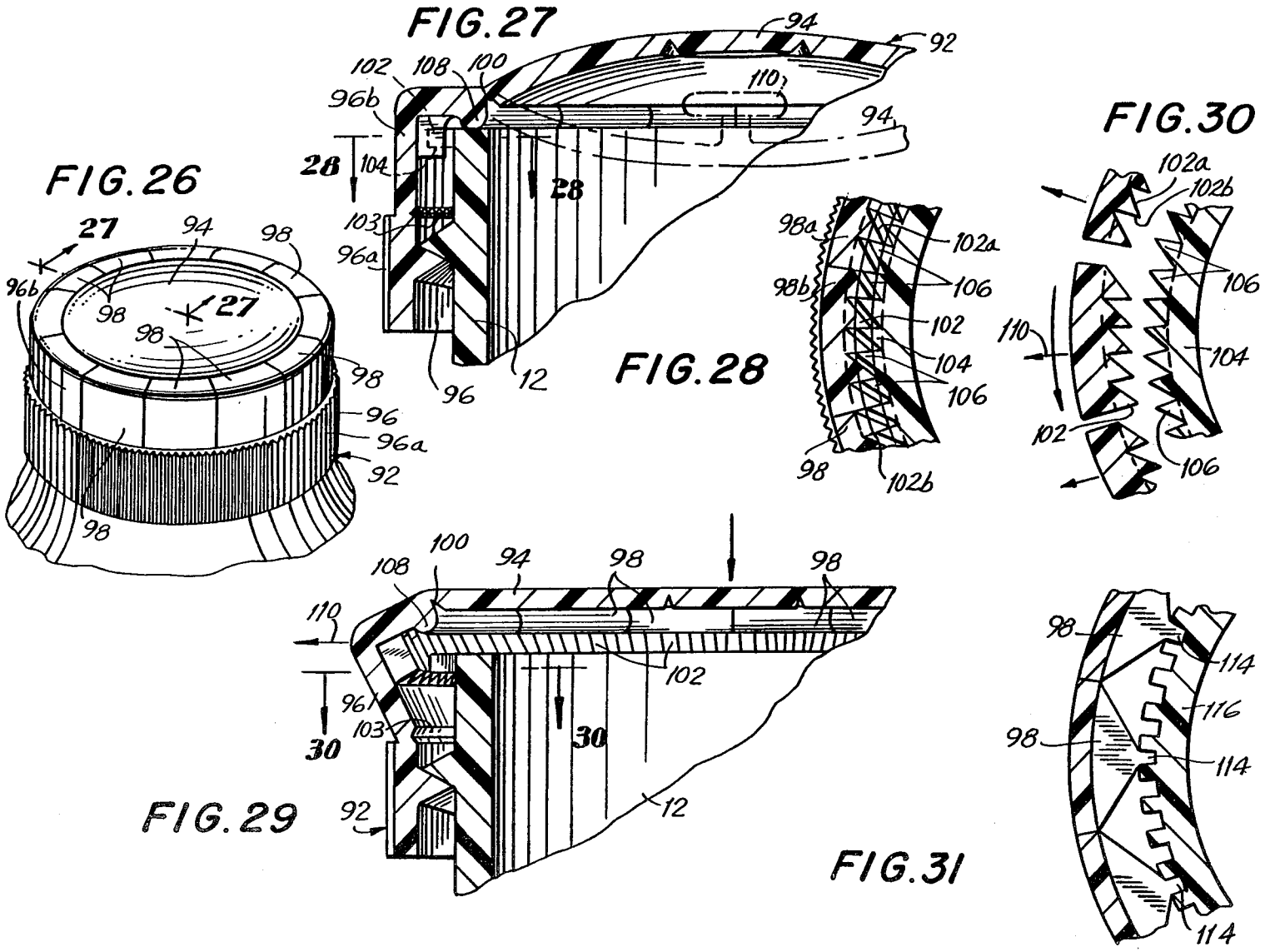
FIG. 26 is a perspective view of still another embodiment of a closure and closure-bottle combination in accordance with the present invention.
FIG. 27, is a section view taken along line 27—27 of FIG. 26.
FIG. 28 is a section view taken along line 28—28 of FIG. 27.
FIG. 29 is a view similar to FIG. 27 and illustrating the closure in its unlocked position on the bottle neck.
FIG. 30 is a section view taken along line 30—30 of FIG. 29.
FIG. 31 is a view similar to FIG. 28 illustrating a modification of the embodiment of the invention illustrated in FIGS. 26–30.

More particularly, the closure 92 includes a peripherally extending skirt 96 having a lower circumferentially extending fluted portion 96*a* and an upper portion 96*b* formed by a plurality of locking segments 98. Each of the locking segments 98 is integrally joined with the top 94 at an upper groove hinge 100 and to the lower fluted portion 96*a* of the skirt by a second groove hinge 103. However, adjacent locking segments 98 are separated from each other as seen in the figures. Thus, as seen in FIG. 28, locking segments 98*a*, 98*b* and 98*c* have respective adjoining side surfaces. Moreover, a plurality of inwardly extending teeth 102 are formed on the inwardly facing surface of each locking segment 98. The teeth 102 preferably have a saw-tooth configuration as best seen in FIGS. 28 and 30, each tooth having an angled leading edge 102*a* in the clockwise direction and a substantially radial trailing edge 102*b*. The upper end of the bottle neck 12 is provided with a toothed rim 104 having a plurality of correspondingly shaped teeth 106 extending outwardly therefrom.

In operation, the closure 92 is applied to the bottle neck with the top 94 in its locking position as illustrated in solid lines in FIG. 27. In this configuration, the locking segments 98 are in their respective locking positions as illustrated in FIG. 27. The cap is rotated in a clockwise direction until it is tightened on the bottle neck with the bead 108 engaging the upper edge surface of the bottle neck. During such clockwise roation, the teeth 102 of the locking segments 98 engage the teeth 106 of the toothed rim 104. However, continued rotation is possible due to the camming action between engaging surfaces of the respective teeth by virtue of the saw-tooth construction described above. However, when the cap is fully tightened over the bottle neck, a counterclockwise untightening rotation is prevented by virtue of the abutment of the radial edges of the respective teeth 102 and 106.

When it is desired to unscrew the closure 92 from the bottle neck, the top 94 is depressed with sufficient force to move the same to a horizontal position as shown in FIG. 29. This results in the peripheral edge regions of the dome-shaped top 94 being moved radially outwardly thereby causing the locking segments 98 to pivot about the first and second groove hinges 100 and 103 as best seen in FIG. 29. Consequently, the locking segments 98 are moved outwardly in the direction of arrow 110 (FIGS. 29 and 30) whereupon the teeth 102 and 106 are disengaged so that a counterclockwise untwisting rotation of the cap is possible. It is noted that unlike the embodiments previously described, the top 94 of closure 92 when in its non-locking position will extend substantially horizontally and not snap into a concave configuration.

One advantage of this embodiment is that the top 94 of closure 92 may be normally positioned with a concave configuration when in its so-called locking position as indicated in phantom in FIG. 27. In this connection, a handle 110 may be formed on the upper surface of the top 94 so that when it is desired to move the locking segments to their non-locking positions, it is only necessary to grasp the handle 110 and raise the top 94 to its horizontal position. This is advantageous in that the top cannot be inadvertently depressed, such as during shipping, by placing objects on top of the closure, Referring to FIG. 31, a modification of the embodiment illustrated in FIGS. 26–30 is shown. In this modification, the locking segments are formed with inwardly extending locking fingers 114 which engage a gear tooth rim 116 provided at the upper end of the bottle neck. It is understood that in the case of such modification, the cap must be in its non-locking mode when screwed onto the bottle neck.

Referring now to FIGS. 32–35, a tamper-resistant embodiment of the invention is illustrated wherein the safety closure **10*b* of the invention has incorporated therewith means for providing a visual indication that the closure has at some time already been detached or removed or at least unlocked from the neck 12** of the container. It is understood, however, that the tamper-resistant feature of the present invention can be applied to other types of closures than of the safety type as described below. More particularly, the tamper-resistant features of the invention are applicable to any type of closure whose contour or configuration must be altered in connection with effecting the removal of the cap from the associated container. Such provision will signal a possible unauthorized tampering with the contents of the container, for example, when removal or unlocking of the closure prior to the sale of the product to the consumer is indicated.

Figure 33:
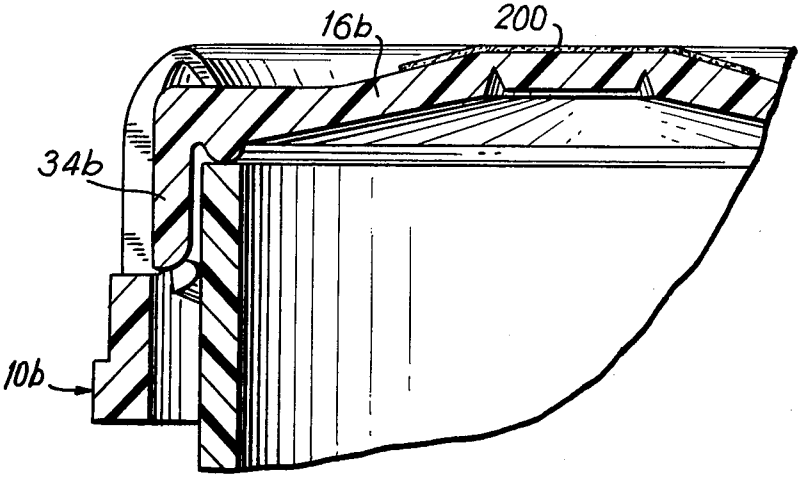
FIG. 33 is a section view taken along line 33—33 of FIG. 32.
Figure 32:
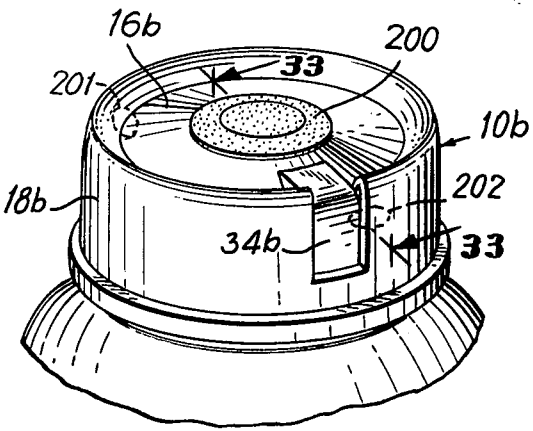
FIG. 32 is a perspective view of one embodiment of a tamper-resistant cap in accordance with the present invention.

In the illustrated embodiment, referring to FIGS. 32 and 33, a thin coating 200 of a non-pliable, brittle and readily frangible substance, such as lacquer or the like, is adhered to the upper surface of the top **16*b* of closure 10*b*. The coating is preferably applied to the central region of top 10 as shown in the figures and may constitute other materials than lacquer, such as paraffin, a resin-like substance, adhesive backed coated paper, tape and the like. The coating is preferably applied by the manufacturer after the container has been filled and the closure associated with the container. In the case where the closure can be associated with the container without depressing the top 16 thereof, the coating can be applied prior to screwing the closure onto the container neck. Prior to the first or initial depression of the closure top in connection with unlocking the closure from the container neck, the coating 200** has a smooth, uninterrupted texture which is readily apparent both visually and palpably.

Figure 35:
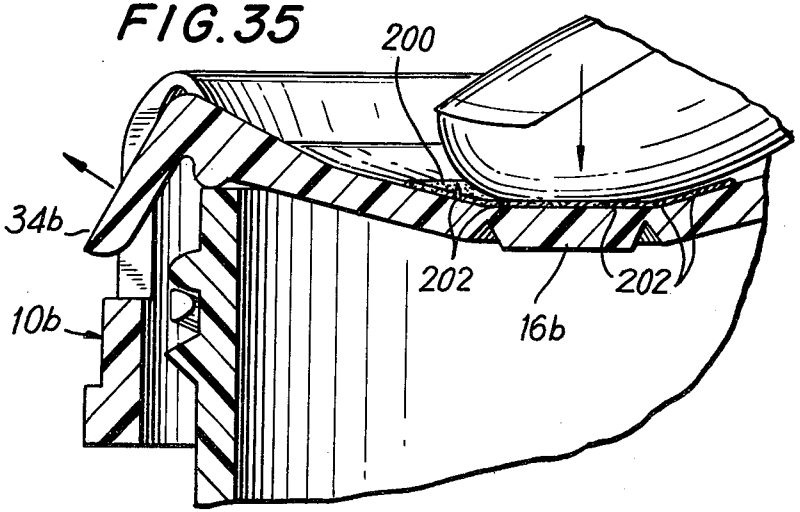
FIG. 35 is a section view taken along line 35—35 of FIG. 34.
Figure 34:
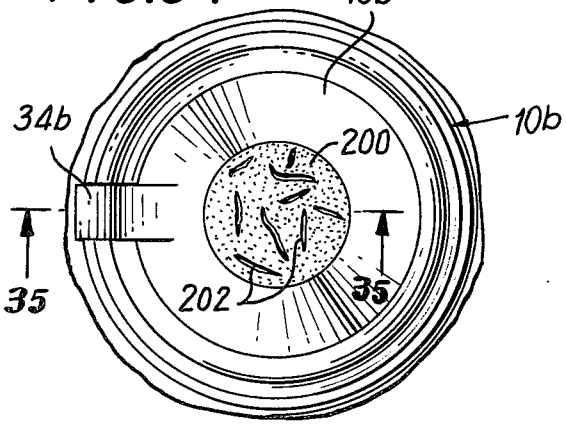
FIG. 34 is a top plan view of the cap of FIG. 32 after the top thereof has been depressed.

Referring now to FIGS. 34 and 35, upon the top **16*b* being depressed for the first time to move the locking member 34*b* to its unlocked position, the frangible coating 200 is cracked or fractured due to the deformation or change in contour of the top, the latter constituting a substrate to which the coating 200 is adhered. The fracturing of coating 200 results in the formation of web-like fracture lines or spidering 202 therein which are visually and palpably apparent from even a casual inspection of the closure 10. In fact, depression of the top 16 may result in entire portions of the coating 200 being separated from the underlying top. Thus, should the closure have ever been removed from the container, such as prior to the consumer purchasing the product, this fact will be readily apparent from the cracking of coating 200. Accordingly, a consumer will be wary to purchase only products where the original smooth and uninterrupted texture of coating 200** appears and tampering with the contents of the container prior to the sale thereof will be prevented or at least be readily apparent to the consumer.

Although the coating 200 has been shown as applied to the central region of the closure top, it will be understood that the same beneficial results are obtained where a coating of nondeformable material is adhered to the surface of any visible portion of a cap which is deformed or whose contour or configuration is altered in connection with the removal of the cap from the container. For example, the coating may be applied in the hinge region designated 201 in FIG. 32. Alternatively, a coating of material may be applied to the region 202 (FIG. 32) extending between the skirt **18*b* and the locking member 34*b***. In this case the coating material will be fractured the first time that the locking member moves to its non-locking position.

Figure 37A:
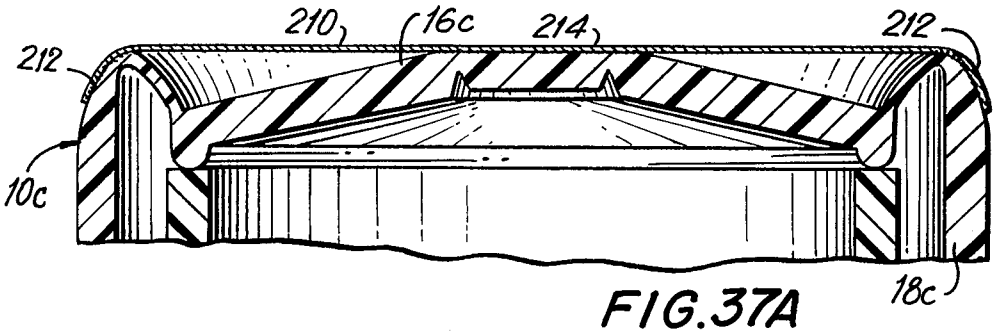
FIGS. 37A and 37B are section views taken along line 37—37 of FIG. 36, FIG. 37A being a view prior to the initial depression of the top of the closure and FIG. 37B being a view subsequent to the initial depression.
Figure 36:
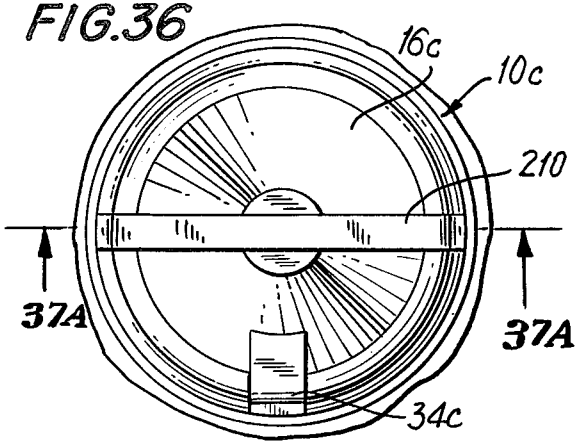
FIG. 36 is a top plan view of another embodiment of a tamper-resistant cap in accordance with the present invention.

Referring now to FIGS. 36 and 37, another embodiment of a tamper-resistant closure is illustrated. Like the embodiment of FIGS. 32–35, this embodiment is applied in connection with a safety closure **10*c* which is similar to that described above in connection with FIGS. 1–9. In this embodiment, a strip or ribbon 210 of relatively non-elastic, rupturable or tearable material such, for example, as paper, metal foil or the like, is fixed to the cap 10*c* by securing the same at its ends to diametrically opposed upper regions of the skirt 18*c* and at its central portion to the central region of the upper surface of top 16*c*. As in the case of the embodiment shown in FIGS. 32–35, the strip may be applied by the manufacturer after the closure has been associated with the container or in the case where the closure can be associated with the container without depressing the top thereof, the strip can be applied prior to associating the cap with the container. Thus, as best seen in FIG. 37A, the strip 210 in a taut condition has its ends 212 irremovably affixed to opposed upper regions of skirt 18*c* while the central portion 214 thereof is irremovably affixed to the central region of top 16*c*. Such affixation may be by a suitable adhesive or by thermal bonding where appropriate, it only being essential that the affixed portions of the strip 210** cannot be separated from the cap without tearing or rupturing the strip.

Figure 37B:
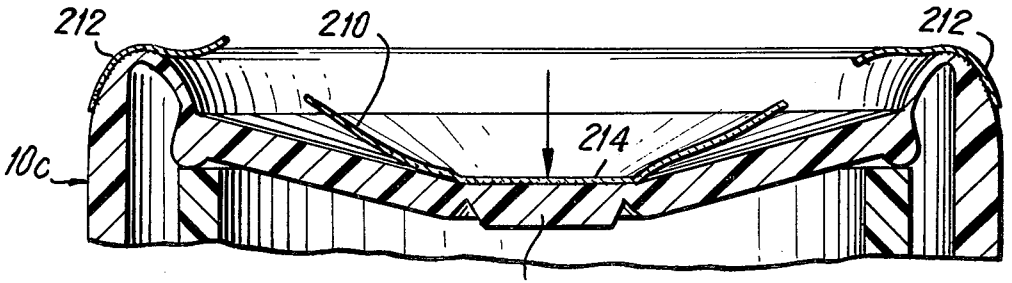

The operation of this embodiment is clearly apparent from the figures. Upon depressing top **16*c* to unlock the closure 10*c* from the container, the distances between the central region and opposed upper skirt regions of the cap increase causing the strip 210 to rupture in the two regions which extend from its central portion 214 to the respective ends 212 as seen in FIG. 37B**. Thus, a strip applied to a cap in this manner by the manufacturer will provide a readily visual indication as to whether the top of the cap has been depressed and the cap possibly removed from the container, a ruptured tape being indicative thereof.

It will also be understood that the strip 210 may be applied to extend only between one upper skirt region and the central top region or for that matter between any two regions of the cap the distance between which will increase upon deformation of the cap in connection with its removal from the container with the same beneficial effects obtained.

Figure 38:
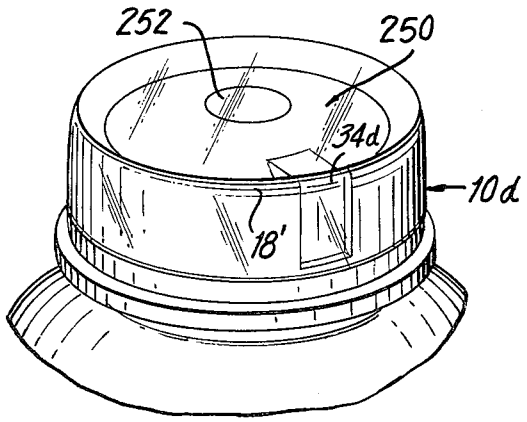
FIG. 38 is a perspective view of yet another embodiment of a tamper-resistant closure in accordance with the present invention.

Referring to the embodiment illustrated in FIG. 38, a sheet or film 250 of relatively inelastic, rupturable or tearable material, such as a suitable plastic, is stretched tautly over the top of a closure **10*d*, similar to caps 10*b* and 10*c*, and securely sealed or fixed to the perimeter of the skirt at its upper region 18' and to the central region 252 of the top 16*d*. As in the case of the strip 210, the sheet 250 is secured to the cap region in a manner such that it cannot be separated therefrom without destroying the sheet. It will be readily understood that when the top of the cap is depressed to unlock the same, the sheet 250** will rupture thereby providing a clear indication that the cap has been unlocked and possible removed from the container.

The embodiments of tamper-resistant closures described above substantially incorporate the construction of the safety cap illustrated in FIGS. 1–9 hereof. However, it is understood that the tamper-resistant closure may also incorporate the construction of the other embodiments of the safety closures described herein. Such tamper-resistant safety closures therefore uniquely combine the advantages provided by the safety closure construction of the present invention with the capability of providing a readily visual indication as to whether the closure has at some time been unlocked and possibly removed from the container.

Moreover, it is understood that the tamper-resistant features of the present invention may be applied to closures of other types. For example, a non-deformable coating can be applied to the surface of the dome-shaped deformable top of the cap disclosed in U.S. Pat. No. 4,187,953 to Turner which cap is of the "snap-fit" type or indeed to any cap which is deformed or whose contour or configuration is altered in connection with the removal thereof from the container. Thus, the tamper-proof features of the invention are not limited except to the extent indicated to any particular cap construction or type.

Figure 39:
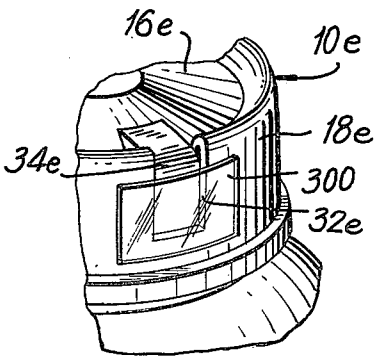
FIG. 39 is a partial perspective view of still another embodiment of a tamper-resistant closure in accordance with the present invention.

Referring now to FIG. 39, still another embodiment of a tamper-resistant closure is illustrated. Unlike the embodiment of FIGS. 32–38, this embodiment is specifically adapted for use in conjunction with a safety closure cap 10*e* of the type illustrated in FIGS. 1–9 herein.

A strip 300 of relatively inelastic rupturable or tearable material, for example of the same type as the material of which strip 210 (FIG. 36) or sheet 250 (FIG. 38) is formed, is securely fixed to the skirt 18*e* of cap 10*e* so as to extend over the slot 32*e* directly outwardly of the locking member 34*e*. It will be understood that when the closure top 16*e* is depressed the locking member 34*e* will begin to pivot outwardly through the slot until it contacts the strip 300 which prevents the locking member from reaching the fully pivoted unlocking position. The strip is so constructed that when a sufficient depressing force is applied to the closure top, such force being greater than the normal force required for merely depressing the top 16*e*, the locking member will bear against the strip with a force sufficient to rupture the same whereupon the locking member can then complete its movement to the unlocking position. A ruptured strip 300 thus provides a readily visible indication that the cap has been unlocked and possibly removed from the container. It is also seen that the strip 300 provides the additional function of normally preventing an inadvertent unlocking of the cap prior to sale since a normal depressing force applied to the top of the closure will be insufficient to cause rupture of the strip 300.

Obviously, numberous modifications and variations of the present invention are possible in the light of the above teachings. It is therefore to be understood that within the scope of the claims appended hereto, the invention may be preacticed otherwise than as specifically disclosed herein.

What is claimed is:

1. A safety closure comprising:

a top having a peripheral edge region;

an interiorly threaded skirt integral with and depending from the peripheral edge region of said top;

locking means formed integrally with said closure and movable under the action of actuating means from a locking position to a non-locking position;

actuating means for moving said locking means from the locking position to the non-locking position, said actuating means being constituted by at least a portion of said top of said closure which has a substantially dish-shaped locking configuration such that the application of a pressure on said top portion in excess of a certain minimum required pressure will deform said top into a non-locking configuration and result in movement of said locking means from the locking to the non-locking position; and means for positively retaining said locking means in said non-locking position after movement thereto from said locking position.

2. The combination of claim 1 wherein at least one slot is formed through said skirt, and wherein said locking means are constituted by at least one tab-like locking member, each locking member being integrally joined to the peripheral edge region of said top and aligned with and receivable within a respective one of said slots.

3. The combination of claim 2 wherein said means for retaining said locking means in said non-locking position includes detention means integrally formed with said closure, said detention means extending into said slot for engaging said locking member after the latter has moved to said locking position.

4. The combination of claim 3 wherein said detention means include a flexible flap integrally formed with said closure, said flap partially extending from a lower edge of said slot into said slot outwardly of the respective locking member aligned therewith when said locking member is in said locking position, whereby said locking member upon moving to said unlocking position, engages and deflects said flexible flap so that in its unlocking position, said locking member is positioned outwardly of said flap.

5. A safety closure and container combination, comprising:

a safety closure, including a top having a peripheral edge region;

an interiorly threaded skirt integral with and depending from the peripheral edge region of said cap, said skirt adapted to threadedly mate with an externally threaded neck of said container means;

locking means formed integrally with said closure and movable under the action of actuating means from a locking position in which the locking means are in engaging relationship with at least one locking element provided on the neck of said container means to a non-locking position in which the locking means are in non-engaging relationship with said at least one locking element; and actuating means for moving said locking means from the locking position to the non-locking position, said actuating means being constituted by at least a portion of said top of said closure which has a substantially dish-shaped locking configuration such that the application of a finger pressure on said top in excess of a certain minimum required pressure will deform said top into a non-locking configuration and result in movement of said locking means from the locking to the non locking position;

container means, including an exteriorly threaded neck; and at least one locking element provided on said neck adapted to engage said locking means when the closure is tightened on said neck with said locking means in the locking position and wherein rotation of said closure in an untightening direction is attempted; and means for positively retaining said locking means in said non-locking position after movement from said locking position and until said closure is rotated so that said locking means are in non-engaging relationship with said locking element.

6. The combination of claim 5 wherein at least one slot is formed through said skirt, and wherein said locking means are constituted by at least one tab-like locking member, each locking member being integrally joined to the peripheral edge region of said top and aligned with and receivable within a respective one of said slots, and wherein said at least one locking element is constituted by a protuberance formed on the exterior surface of said neck of said container means, said protuberance presenting a substantially radial surface adapted to engage a corresponding locking member when the latter is in its locking position and the closure is rotated in the untightening direction.

7. The combination of claim 6 wherein said means for retaining said locking means in said non-locking position includes detention means integrally formed with said closure extending into said slot for engaging said locking member after the latter has moved to said locking position and retaining means integrally formed on the external surface of said container means neck situated inwardly of said detention means when the closure is screwed tightly onto said container means neck.

8. The combination of claim 7 wherein said detention means include a flexible flap integrally formed with said closure, said flap partially extending from a lower edge of said slot into said slot outwardly of the respective locking member aligned therewith when said locking member is in said locking position, whereby said locking member upon moving to said unlocking position, engages and deflects said flexible flap so that in its unlocking position, said locking member is positioned outwardly of said flap.

9. The combination of claim 8 wherein said retaining means comprises a portion of said protuberance constituting said locking element.

10. The combination of claim 8 wherein said protuberance constituting said locking means and said retaining means comprise a portion of the threads formed on the neck of said container means.

11. The combination of claim 5 wherein said top tends to return to said locking configuration upon removal of the finger pressure therefrom and said locking means retaining means further constitute means for retaining said top in said non-locking position until said closure is rotated so that said locking means are in non-engaging relationship with said locking element.

12. A tamper-resistant closure for closing a container comprising:

a top portion;

a peripheral portion integrally formed with said top portion including means for attaching said closure to a container;

at least a first region of said closure being adapted to move with respect to at least a second region of said closure during detachment of said closure from the container; and non-deformable means fixed only to said closure and at least to said first and second regions thereof which move with respect to each other during detachment of the closure for providing a visual indication that said first and second regions have moved with respect to each other.

13. The combination of claim 12 wherein said visual indication means comprises a unitary coating of a non-pliable substance adhered to at least said first and second regions of said closure, said coating being formed of a substance such that upon relative movement of said first and second closures regions, said coating splits, fractures or becomes separated from said closure.

14. The combination of claim 13 wherein said closure top portion includes said first and second regions, said top being formed of a resilient deformable material.

15. The combination of claim 12 wherein said closure includes an actuating region having a configuration or contour which is adapted to be altered in order to effect detachment of said closure from the container and wherein said non-deformable visual indication means includes a first portion which is secured to said actuating region of said closure and at least a second portion which is secured to a region of said closure which has a configuration of contour which is not altered in connection with the detachment of said closure from the container.

16. The combination of claim 15 wherein said closure top portion comprises said actuating region, said top being formed of a resilient deformable material.

17. The combination of claim 12 wherein said closure top portion comprises said actuating region and said visual indication means comprise a sheet of substantially inelastic material tautly stretched over said top portion, one portion of said sheet being secured to said top portion and another portion of said sheet being secured to another region of said closure, whereby upon deformation of said top portion in connection with detaching said closure from the container, said sheet is ruptured.

18. A combination safety and tamper-resistant closure comprising:

a top having a peripheral edge region;

an interiorly threaded skirt integral with and depending from the peripheral edge region of said top;

locking means formed integrally with said closure and movable under the action of actuating means from a locking position to a non-locking position;

actuating means for moving said locking means from the locking position to the non-locking position, said actuating means being constituted by said top of said closure at least a portion of which has a substantially dish-shaped locking configuration such that the application of a pressure on said top in excess of a certain minimum required pressure will deform said top into a non-locking configuration and result in movement of said locking means from the locking to the non-locking position; and means operatively associated with said closure for providing a visual indication that at some time said locking means have moved from said locking position to said non-locking position.

19. The combination of claim 18 wherein said visual indication means are operatively associated with said deformable top.

20. The combination of claim 19 wherein said visual indication means comprises a coating of a non-pliable substance adhered to at least said resilient deformable region of said top portion, whereby upon deformation of said top portion in connection with detaching said closure from the container, said coating is split, fractured or separated from said deformable region.

21. The combination of claim 21 wherein said non-pliable substance is selected from the group consisting of lacquer, paraffin, a resin-like substance, adhesive backed coated paper and tape.

22. The combination of claim 19 wherein said visual indication means comprises a strip of substantially non-elastic material, a first portion of which is secured to said deformable region of said top portion and at least a second portion of which is secured to another region of said closure so that the portion of the strip extending between said first and second portions thereof being in a taut condition when said top is in an undeformed condition, whereby upon deformation of said top portion in connection with detaching said closure from the container, said strip is ruptured.

23. The combination of claim 19, wherein said visual indication means comprise a sheet of substantially inelastic material tautly stretched over said top portion, one portion of said sheet being secured to said deformable region of said top portion and another portion of said sheet being secured to another region of said closure, whereby upon deformation of said top portion in connection with detaching said closure from the container, said sheet is ruptured.

24. The combination of claim 18 wherein at least one slot is formed through said skirt, and wherein said locking means are constituted by at least one tab-like locking member, each locking member being integrally joined to the peripheral edge region of said top and aligned with and receivable within a respective one of said slots.

25. The combination of claim 24 wherein said visual indication means comprises a strip of substantially inelastic material affixed to said skirt so as to extend over said slot directly outwardly of said locking member, whereby upon said closure top being depressed, said locking member will pivot outwardly and engage and rupture said strip.

26. The combination of claim 13 wherein said non-pliable substance is lacquer.

27. The combination of claim 13 wherein said non-pliable substance is paraffin.

28. The combination of claim 13 wherein said non-pliable substance is a resin-like substance.

29. The combination of claim 13 wherein said non-pliable substance is an adhesive backed coated paper.

30. The combination of claim 13 wherein said non-pliable substance is a non-deformable tape.

31. The combination of claim 15 wherein said visual indication means comprises a strip of substantially non-deformable material and wherein the length of said strip extending between said first and second portions thereof is in a taut condition when said actuating region is in an undeformed condition, whereby upon altering the contour or configuration of said actuating region in connection with detaching said closure from the container, said strip is ruptured.

32. A closure member formed of deformable material adapted to be threadedly fastened onto the neck of a container, said closure member including a top and a portion adapted to skirt the exterior of the container neck, comprising locking means formed integrally with said closure member, said locking means being contiguous with said skirting portion and movable between a first locking position and a second non-locking position, said second non-locking position being spaced outwardly of said first locking position; and means for moving said locking means between said first and second positions, said moving means including a resilient deformable portion of said closure member;

whereby when said deformable portion is in its normal configuration, said locking means are in said first position and when said deformable portion is deformed said locking means are moved to said second position.

33. The combination of claim 32 wherein said locking means comprise a region having teeth formed thereon adapted to engage at least one corresponding locking member formed on the container when in said first position.

34. The combination of claim 18 wherein said visual indicating means comprises said dish-shaped portion of said closure top.

* * * * *